US008726818B2

(12) United States Patent
Tongu et al.

(10) Patent No.: US 8,726,818 B2
(45) Date of Patent: May 20, 2014

(54) BURNING METHOD OF WOODY PELLET AND BURNING APPARATUS THEREOF

(75) Inventors: Shinji Tongu, Hamamatsu (JP); Muneo Iwauchi, Hamamatsu (JP)

(73) Assignee: Yazaki Energy System Corporation, Tokyo (JP)

( * ) Notice: Subject to any disclaimer, the term of this patent is extended or adjusted under 35 U.S.C. 154(b) by 483 days.

(21) Appl. No.: 13/055,326

(22) PCT Filed: Jul. 22, 2009

(86) PCT No.: PCT/JP2009/063086

§ 371 (c)(1),
(2), (4) Date: Jan. 21, 2011

(87) PCT Pub. No.: WO2010/010886

PCT Pub. Date: Jan. 28, 2010

(65) Prior Publication Data

US 2011/0120355 A1 May 26, 2011

(30) Foreign Application Priority Data

Jul. 22, 2008 (JP) ..... 2008-188485

(51) Int. Cl.
*F23G 5/00* (2006.01)
*F23B 30/10* (2006.01)
*F23H 13/00* (2006.01)

(52) U.S. Cl.
USPC ..... 110/258; 110/208; 110/248; 110/295; 110/229; 110/346; 110/281

(58) Field of Classification Search
CPC ..... F23B 1/16; F23B 1/26; F23B 30/00; F23B 60/00; F23B 60/02; F23G 2203/40; F23G 2203/401; F23G 2203/403; F23G 2900/50005; F23H 15/00; F23J 1/00; F23J 1/06; F23J 9/00
USPC ..... 110/208, 209, 248, 295, 315, 346, 166, 110/170, 229, 230, 210, 211, 328, 268, 281, 110/282, 258, 165 R, 169; 126/152 R, 173, 126/174
See application file for complete search history.

(56) References Cited

U.S. PATENT DOCUMENTS 4,711,185 A * 12/1987 Hofmann et al. ..... 110/215
5,103,744 A * 4/1992 Tunstromer ..... 110/233

(Continued)

FOREIGN PATENT DOCUMENTS

JP 61-110804 A 5/1986
JP 62-112435 U 7/1987

(Continued)

OTHER PUBLICATIONS

Machine translation of JP 2006-275301 to Sugimoto et al.*

(Continued)

*Primary Examiner* — Kenneth Rinehart
*Assistant Examiner* — David J Laux
(74) *Attorney, Agent, or Firm* — Sughrue Mion, PLLC

(57) ABSTRACT

To suppress the generation of clinker so as to prevent the generation of a burning trouble, ceramic particles 30 are covered over a porous plate 4 to form a fire bed 3. Woody pellets 31 are scattered on the fire bed and combustion air is ejected from the lower side of the porous plate so as to burn the pellets. At the time of discharging ash generated by the burning to a secondary combustion space on the downstream side together with an air current of the combustion air or combustion gas, the ceramic particle layers and the woody pellet layer are stirred by a stirring section 21, 22 to thereby break clinker of the combustion ash formed in the fire bed, whereby the growth of the clinker is suppressed and the generation of a burning trouble is prevented.

1 Claim, 7 Drawing Sheets

(56) References Cited

U.S. PATENT DOCUMENTS

| | | | | |
|---|---|---|---|---|
| 5,605,104 | A * | 2/1997 | Gross et al. | 110/346 |
| 7,648,615 | B2 * | 1/2010 | Araki | 110/245 |
| 2002/0174812 | A1 * | 11/2002 | Shionoya et al. | 110/346 |
| 2006/0133973 | A1 * | 6/2006 | Saares | 422/239 |

FOREIGN PATENT DOCUMENTS

| | | | |
|---|---|---|---|
| JP | 07-318034 | A | 12/1995 |
| JP | 09-125071 | A | 5/1997 |
| JP | 2005-61721 | A | 3/2005 |
| JP | 2006-504922 | A | 2/2006 |
| JP | 2006-275301 | A | 10/2006 |

OTHER PUBLICATIONS

Machine translation of JP 09-125071 to Koshiba.*

Office Action, dated Nov. 27, 2012, issued by the Japanese Patent Office in counterpart Japanese Patent Application No. 2008-188485.

International Search Report, dated Oct. 27, 2009, issued in Application No. PCT/JP2009/063086.

Office Action dated Aug. 5, 2013 issued by the State Intellectual Property Office of People's Republic of China in counterpart Chinese Application No. 200980129051.1.

* cited by examiner

BURNING METHOD OF WOODY PELLET AND BURNING APPARATUS THEREOF

TECHNICAL FIELD

The present invention relates to a method and an apparatus for burning woody pellets and, in particular, relates to a method and an apparatus for burning woody pellets on a fire bed formed by ceramic particle layers.

BACKGROUND TECHNIQUE

In order to cope with an environmental problem of global warming, biomass fuel has been notified which does not influence on the increase/decrease of carbon dioxide in the atmosphere in a view point of fuel life cycle, that is, which absorbs carbon oxide due to the photosynthesis in the growing process of plant by an amount almost same as carbon dioxide generated at the time of burning. Among the biomass fuel, woody pellet is in general a solid fuel which is formed by grinding and subjecting a compression forming with respect to scrap wood or remaining wood in the forest etc. generated by final cutting or forest thinning. The woody pellet is stable in its shape and quality such as a water content ratio. Thus, since the woody pellet can be treated easily as compared with other biomass fuel, the development of the use of the woody pellet has been examined widely as fuel for various kinds of heat sources such as a hot-water boiler, a steam boiler, a heat source of a greenhouse, a water heater, a heating equipment, a regenerator of absorption refrigeration cycle.

Since the woody pellet generates a relatively large amount of combustion ash, the discharging of the combustion ash is a problem for performing a stable burning. For example, a patent document 1 proposes a burning apparatus in which ceramic particles are covered all over a porous plate having many air ejection holes to form a fire bed, then woody pellets are dispersed on the fire bed of the ceramic particle layers, and combustion air is flowed into the ceramic particle layers from the lower side of the porous plate to thereby flow and burn the woody pellets. According to this apparatus, the combustion ash is scattered into a secondary combustion chamber on the downstream side together with the combustion air and the combustion gas flowing through the ceramic particle layers, then moves downward and deposits within the secondary combustion chamber and is suitably discharged to the outside of the combustion chamber. On the other hand, the ash not deposited in the secondary combustion chamber is flown together with the combustion gas and collected by a cyclone etc.

PRIOR ART DOCUMENT

Patent Document

Patent Document 1: JP-A-2006-275301

SUMMARY OF THE INVENTION

Problems that the Invention is to Solve

However, if a high-temperature area is formed at the fire bed due to any reason such as the congestion of the woody pellets, the deposited ash may melt and sinter to form clinker of burnt ash (hereinafter called clinker). Since such the clinker is not blown away by the normal air flow of combustion air, the clinker becomes larger gradually to thereby cause a burning trouble such as incomplete combustion. Thus, it is necessary not to deposit the clinker on the fire bed.

When the burning trouble is caused once, it is necessary to stop the operation of the burning apparatus and to remove the clinker or the deposited ash by human power. Thus, there arises a problem that not only time and human power is required for the maintenance of the apparatus but also the operation efficiency of the burning apparatus degrades.

On the other hand, if a flowing rate of the combustion air etc. is increased in order to blow away the clinker deposited on the fire bed, since the woody pellets not completely burnt yet may be scattered, the burning rate of the woody pellets may be reduced.

A problem to be solved by the invention is to suppress the growth of clinker to so as to prevent the generation of a burning trouble.

Means for Solving the Problems

In order to solve the aforesaid problem, a burning method of woody pellets according to the invention relates to a method of burning woody pellets in which ceramic particles are covered over a porous plate to form a fire bed, the woody pellets are scattered on the fire bed, and combustion air is ejected from a lower side of the porous plate to burn the woody pellets so as to discharge ash generated by the burning to a secondary combustion space on a downstream side together with an air current of the combustion air or combustion gas, wherein a layer of the ceramic particles and a layer of the woody pellets are stirred by a stirring member so as to break clinker of combustion ash to be formed in the fire bed. In this case, of course, the size of the particle is larger than the diameter of the hole of the porous plate That is, the clinker is broken finely by stirring the ceramic particle layers and the woody pellet layer of the fire bed by the stirring member and further the clinker is broken into fine pieces by the vertical and left- and right-direction movements of the ceramic particles and the woody pellets. As a result, since the ash is scattered and discharged from the fire bed by the normal flow of the combustion air or the combustion gas, the growth of the clinker at the fire bed can be suppressed. As a result, the generation of the burning trouble can be prevented.

At the time of starting the operation, when the fire bed is stirred, since the woody pellets is flattened and so a flame of a firing burner may not reach the woody pellets, the firing property may be degraded. Thus, it is preferable not to stir the fire bed at the time of starting the operation.

A burning apparatus for directly executing the burning method of woody pellets according to the invention is an apparatus for burning woody pellets, which includes: a porous plate which includes many holes; a fire bed which is formed by covering ceramic particles in a layer manner on the porous plate; a fuel supply section which supplies woody pellets on the fire bed; an air supply section which supplies combustion air to the fire bed from the holes of the porous plate; a firing burner which fires the woody pellets; a secondary combustion space which introduces combustion gas generated from the fire bed therein and burns the gas; a stirring section which stirs the layer of the ceramic particles on the fire bed by using a member which moves along a plate surface of the porous plate.

As a mode of the stirring section, the stirring section may be configured by a movable member of a straight shape which is supported so as to be movable along the porous plate and is provided within the layers of the ceramic particles; a stirring member which is provided along the porous plate so as to be orthogonal and fixed to the movable member; and a driving section which is coupled to one end of the movable member that is extracted to an outside of the fire bed.

According to this configuration, when the driving section is operated to reciprocally move the movable member linearly, the stirring member is moved within the fire bed in accordance with the movement of the movable member so as to stir the ceramic particles and the woody pellets. The clinker is broken finely by moving the stirring member and further the clinker is broken into fine pieces by the vertical and left- and right-direction movements of the ceramic particles and the woody pellets. As a result, since the ash is scattered and discharged from the fire bed by the normal flow of the combustion air or the combustion gas, the deposition of the ash can be reduced to thereby suppress the growth of the clinker at the fire bed. As a result, the generation of the burning trouble can be prevented.

In this case, the stirring member can be formed by a rod-shaped member that is disposed so as to be orthogonal and fixed to the movable member; and pin members each of which is provided so as to be erected from the rod-shaped member toward an upper direction of the fire bed. Thus, the clinker is broken further finely by stirring the ceramic particle and the woody pellet by means of the pin members. In this case, at least surface of each of the pin members is preferably formed by heat-resistant material.

As another mode of the stirring section, the stirring section may be configured in a manner that the fire bed is formed by covering the ceramic particles in a layer manner in an area surrounded by a pair of side plates disposed vertically with respect to the porous plate and a front plate and a rear plate respectively disposed at both ends of the side plates; and, in the case where the porous plate is formed in a manner of being supported so as to be movable in front and rear directions in a manner that a front end and a rear end thereof are respectively inserted into slits formed at the front plate and the rear plate, the stirring section includes a plurality of long holes each elongated in a vertical direction which are formed at each of the pair of the side plates of the fire bed in a manner that the long holes are formed with an interval in the front and rear direction of the side plates at corresponding opposed positions of the side plates; a plurality of stirring rods each of which is inserted in corresponding pair of the opposed long holes of the pair of the side plates; and a driving section which moves the porous plate in the front and rear directions.

According to this configuration, when the porous plate is moved in the front and rear directions, the ceramic particles is caught in the air ejection holes of the porous plate and so moves vertically in a vibrational manner. In this case, since the vertical movement of the ceramic particles is restricted by the plurality of stirring rods each provided so as to bridge between the opposed long holes formed at the pair of the side plates, the ceramic particles move in a complicated manner. Thus, the clinker is broken finely by the complicated movements of the ceramic particles and further the clinker is broken into fine pieces by the vertical and left- and right-direction movements of the ceramic particles and the woody pellets. Since the stirring rod moves vertically within the long holes, the vertical movements of the ceramic particles is permitted, whereby forces applied to the porous plate and the stirring rods can be weakened.

In this case, the ceramic particle has preferably a spherical (ball) shape and preferably the diameter of the ceramic particle is larger than the diameter of the hole of the porous plate. Thus, since the lower portion of the ceramic particle is buried into the hole of the porous plate, even when the ceramic particle is forced to move in accordance with the front- and rear-direction movement of the porous plate, the movement of the ceramic particle is interfered by the adjacent other ceramic particles, whereby the ceramic particle moves vertically in a manner of springing out from the hole of the porous plate. Due to such the movement of the ceramic particles, the clinker is broken finely and the ash deposited on the layer of the ceramic particles is stirred and scattered. Although a height of the stirring rod from the porous plate is not particularly limited, this height is preferably about 2.5 times or more as large as the size of the ceramic particle.

Effects of the Invention

According to the invention, it is possible to suppress the growth of clinker to thereby prevent the generation of a burning trouble.

MODES FOR CARRYING OUT THE INVENTION

Hereinafter, an embodiment of a burning apparatus for implementing the burning method of woody pellets according to the invention will be explained.

Embodiment 1

Figure 1:
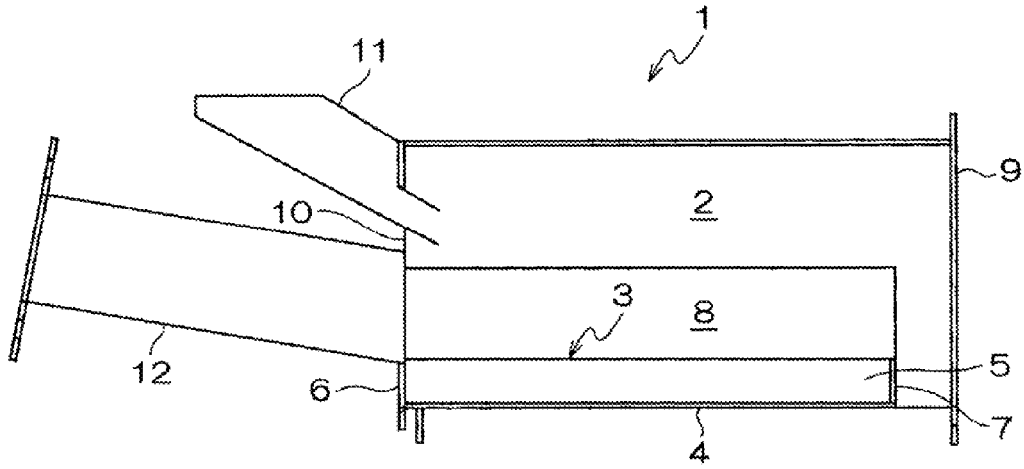
FIG. 1 is a sectional diagram showing a combustion furnace according to the embodiment 1 which is applied to a burning apparatus according to the invention.
Figure 2:
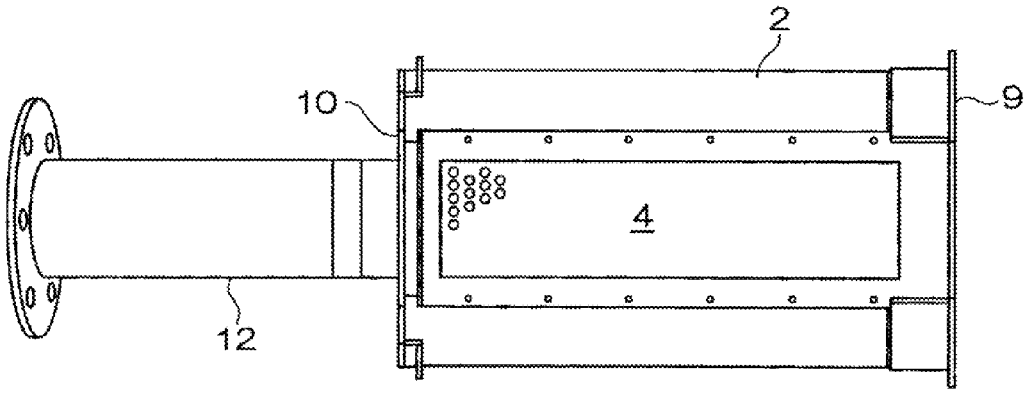
FIG. 2 is a bottom view of the combustion furnace of FIG. 1 seen from the lower side thereof.
Figure 3:
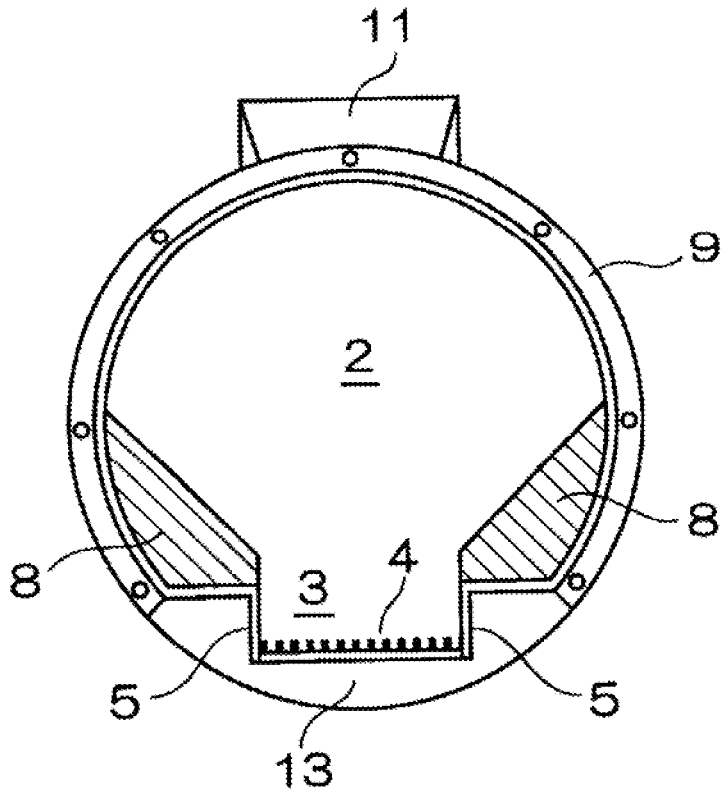
FIG. 3 is a side view of the combustion furnace of FIG. 1 seen from the right side thereof.
Figure 4:
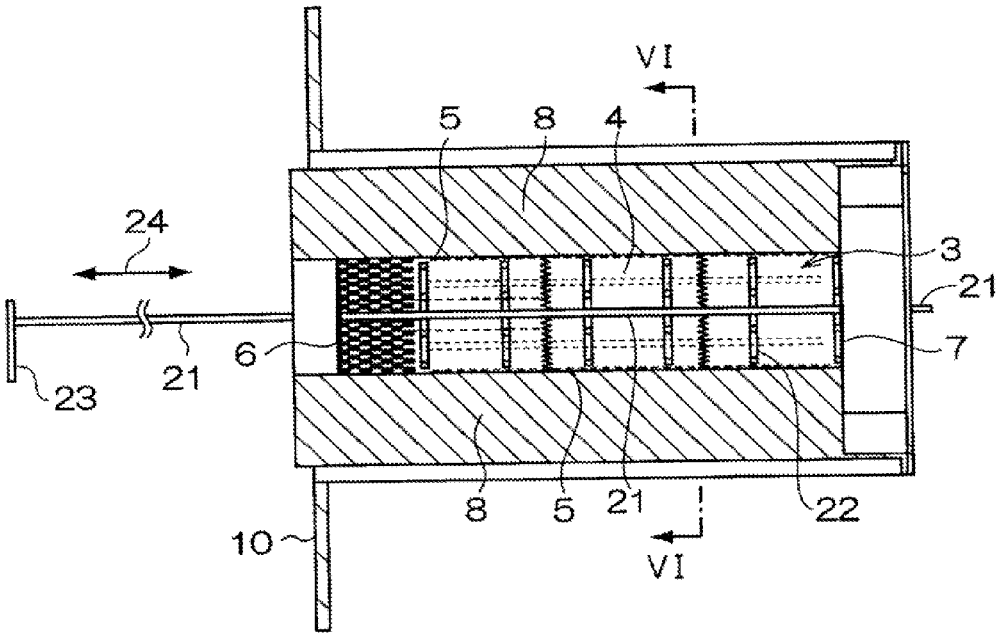
FIG. 4 is a sectional diagram of a fire bed seen from the upper side in which a stirring section as a characterizing part of the embodiment 1 is incorporated
Figure 5:
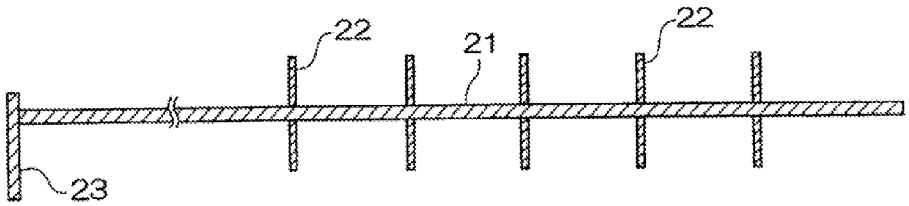
FIG. 5 is a diagram showing the configuration of the stirring section of the embodiment 1.
Figure 6:
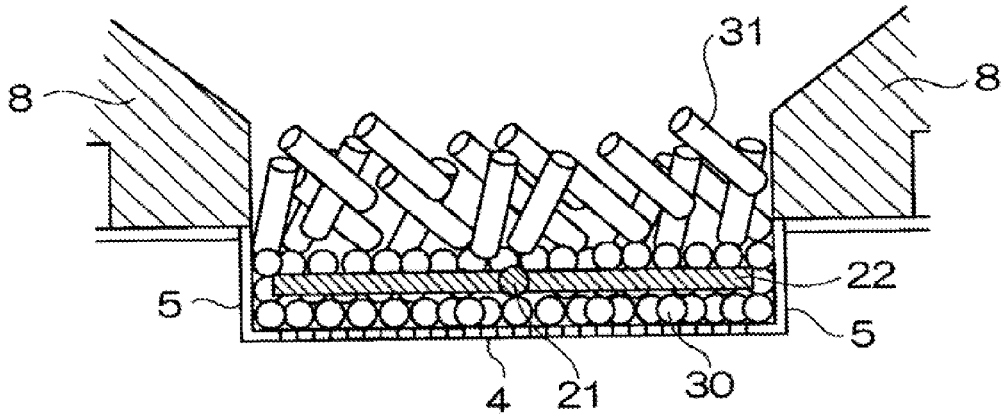
FIG. 6 is a sectional diagram seen along an arrow VI-VI in FIG. 4.

FIGS. 1 to 6 show diagrams of configuration of the first embodiment of the burning apparatus according to the invention. FIG. 1 is a sectional diagram showing a combustion furnace according to the embodiment, FIG. 2 is a bottom view of the combustion furnace seen from the lower side, and FIG. 3 is a side view of the combustion furnace of FIG. 1 seen from the right side. In FIG. 3, the members on the left side in the figure of the combustion furnace are omitted in order to simplify the drawing. FIG. 4 is a sectional diagram of a fire bed seen from the upper side in which a stirring member as a characterizing part of the embodiment is incorporated, FIG. 5 is a diagram showing the configuration of the stirring section, and FIG. 6 is a sectional diagram seen along an arrow VI-VI in FIG. 4.

The combustion furnace 1 used in the woody pellet burning apparatus according to the embodiment is configured in a manner that the fire bed 3 is formed at the bottom portion of a cylindrical combustion chamber 2 as shown in FIGS. 1 to 3. The fire bed 3 is configured in a manner that not-shown ceramic balls are covered in plural layer manner over an area surrounded by a pair of side plates 5, 5 disposed vertically with respect to a porous plate 4 provided at the bottom portion, and a front plate 6 and a rear plate 7 which are respectively disposed at the both ends of the side plates 5, 5. As shown in FIG. 3, a pair of heat-resistant members 8, 8 are filled toward the inner wall at the upper portion of the combustion chamber 2 from the upper ends of the pair of side plates 5, 5.

The right end in the figure of the combustion chamber 2 thus configured is coupled to a not-shown secondary air chamber via a flange 9. The tip end of a shooter 11 for the woody pellets is inserted into the upper portion of a front wall 10 at the left end of the combustion chamber 2. The woody pellets are supplied from a not-shown supply device to the upper opening of the shooter 11. A burner tube 12 having a flange to which a not-shown firing burner is attached is mounted at the lower portion of the front wall 10 of the combustion chamber 2. The firing burner is attached so as to blow a flame toward the upper surface of the fire bed 3. A primary air path 13 is formed below the porous plate 4 so that combustion air is supplied thereto from a not-shown air blower.

Next, the explanation will be made with reference to FIGS. 4 to 6 as to the stirring section for the fire bed 3 which is the characterizing part of the embodiment. FIG. 4 is a diagram showing the fire bed 3 seen from the upper side. As shown in the figure, the fire bed 3 is formed in a manner that the ceramic particles are covered in plural layer manner over the rectangular area surrounded by the pair of side plates 5, 5 disposed vertically on the upper surface of the porous plate 4, the pair of the heat-resistant members 8, 8, and the front plate 6 and the rear plate 7 which are respectively disposed at the both ends of the side plates and the heat-resistant members. A straight-shaped movable member 21 is provided in a manner of being disposed within the ceramic layers forming the fire bed 3 and supported so as to be movable along the porous plate 4. Further, as shown in FIG. 5, a stirring member 22 is provided in a manner of being formed by a plurality of rod-shaped members which are fixed to the movable member 21 so as to be orthogonal thereto along the porous plate 4. The one end of the movable member 21 is supported by the front plate 6 of the fire bed 3 and extracted to the outside. A handle 23 as a driving section is attached to the end portion of the movable member.

The operation of the embodiment thus configured will be explained with reference to FIG. 6. The ceramic balls 30 are covered in the plural layer manner over the porous plate 4 to form the fire bed 3. Then, the woody pellets 31 are supplied on the fire bed 3 in a dispersed manner from the shooter 11, then the combustion primary air is ejected from the lower side of the porous plate 4, and the firing burner is fired to burn the woody pellets 31. The ash generated by the burning is discharged into a not-shown secondary combustion chamber on the downstream side together with an air current of the combustion air or the combustion gas.

During the combustion process, there may arise a case that a high-temperature area is formed within the fire bed 3 due to any reason such as a congestion of the woody pellets 31. When the high-temperature area is formed within the fire bed 3, the combustion ash is melted and sintered to form clinker. Since such the clinker can not be blown away by the normal air current of the combustion air, the clinker becomes larger gradually. Thus, there arises a problem that the clinker causes a burning trouble such as the incomplete combustion to thereby reduce the operation efficiency.

Thus, according to the embodiment, the handle 23 is intermittently or continuously operated suitably during the operation of the combustion furnace 1 to move the movable member 21 in the front and rear directions along the arrow 24 in FIG. 4 to thereby move the plurality of stirring members 22 in the front and rear directions within the fire bed 3 so that the layers of the ceramic balls 30 are mixed. The woody pellets 31 are mixed by the mixing operation of the ceramic balls 30 and the combustion ash is scattered into the secondary air chamber together with the air current of the combustion air and the combustion gas. Further, when the clinker is formed by the combustion, the clinker is broken finely by the plurality of stirring members 22 and further the clinker is broken into fine pieces by the vertical and left- and right-direction movements of the ceramic balls 30 and the woody pellets 31.

Thus, according to the embodiment, since the ash is scattered by the normal flow of the combustion air or the combustion gas and discharged from the fire bed 3, the growth of the clinker at the fire bed 3 can be suppressed. As a result, the generation of the burning trouble can be prevented.

Of course, the size of the ceramic ball 30 is larger than the diameter of the hole of the porous plate 4. Further, the height of the movable member 21 and the stirring member 22 from the porous plate 4 is set preferably to be higher than the height of the single layer of the ceramic balls 30 and lower than the height of the two or three layers thereof.

Further, according to the embodiment, although the explanation is made as to the example where the plurality of the stirring members 22 are fixed in a comb tooth manner to the both sides of the single straight movable member 21, the invention is not limited thereto. That is, a frame-shaped stirring section may be configured in a manner that two movable members each having a straight shape are disposed in parallel to the pair of the side plates 5, 5 to form a frame shape, and each of a plurality of the stirring members 22 is disposed between the two movable members and fixed thereto. In this case, in order to secure a movable range in the front and rear directions of the frame shape, the entire length of the frame-shaped movable members is formed so as to be shorter by the movable range than the length of the fire bed 3 in the front and rear directions, and a straight-shaped movable member is fixed to each of the both ends in the longitudinal direction of the frame-shaped movable members so that the frame-shaped movable members is supported by the front plate 6 and the rear plate 7 in a movable manner.

Embodiment 2

The explanation will be made with reference to FIGS. 7 to 9 as to another embodiment of the stirring section for the fire bed 3 relating to the characterizing portion of the invention.

Figure 7:
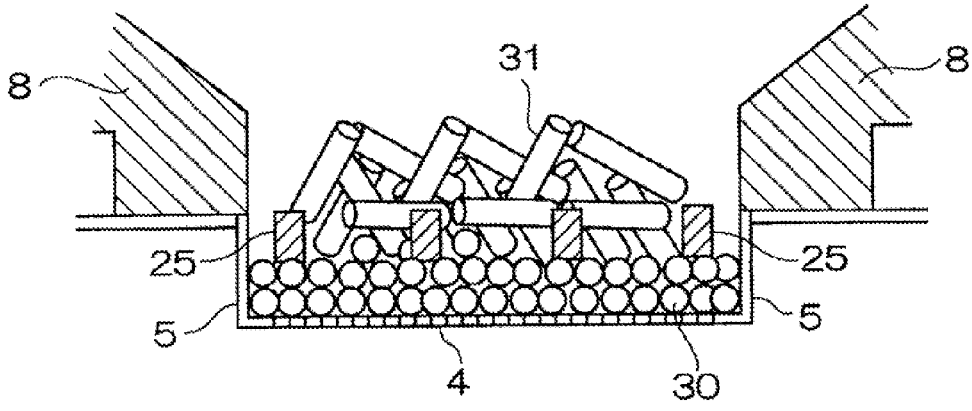
FIG. 7 is a sectional diagram showing the characterizing part the stirring section of the embodiment 2 which is applied to the burning apparatus according to the invention.

This embodiment differs from the stirring section according to the embodiment 1 in a point that a plurality of pin members 25 are provided so as to be erected upward of the fire bed 3 at the stirring member 22 formed by the plurality of the rod-shaped members as shown in FIG. 7. The other portions of this embodiment are same as those of the embodiment 1 and so the explanation thereof will be omitted.

Figure 8:
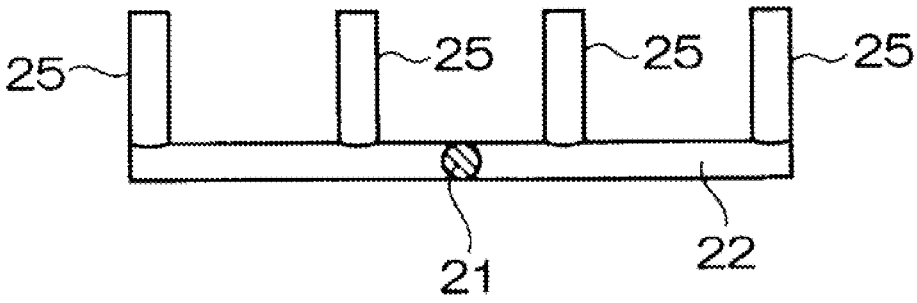
FIG. 8 is a diagram for explaining the configuration of the pin members of the stirring section according to the embodiment 2.
Figure 9:
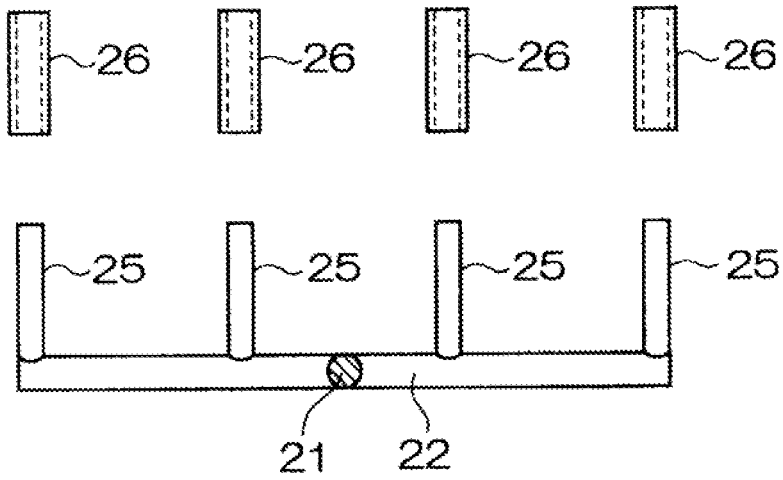
FIG. 9 is a diagram for explaining a modified example of the pin members according to the embodiment 2.

As shown in FIG. 8, the pin members 25 are preferably subjected to the heat-resistant and corrosive-resistant coating such as the hot-dip aluminum plating or the ceramic spraying. Alternatively, instead thereof, as shown in FIG. 9, each of the pin members 25 is preferably coated by a heat-resistant cover 26 formed by a cylindrical member made of ceramic.

According to this embodiment, in addition to the effects of the embodiment 1, the stirring effects of the pin members 25 can be obtained. Thus, the growth of the clinker at the fire bed 3 can be further suppressed, whereby the generation of the burning trouble can be prevented.

Embodiment 3

Figure 10A:
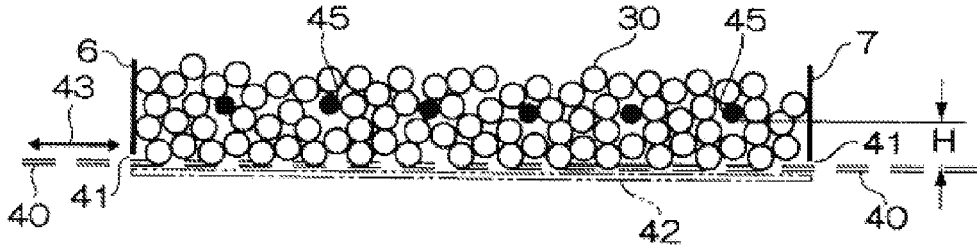
FIG. 10 are diagrams showing the configuration of the stirring section according to the embodiment 3 which is applied to a burning apparatus according to the invention, wherein FIG. 10(*a*) is a sectional diagram showing the periphery of the fire bed 3, FIG. 10(*b*) is a side view showing a partially-broken section of the fire bed 3, and FIG. 10(*c*) is a bottom view of the fire bed 3 seen from the lower side.
Figure 10B:
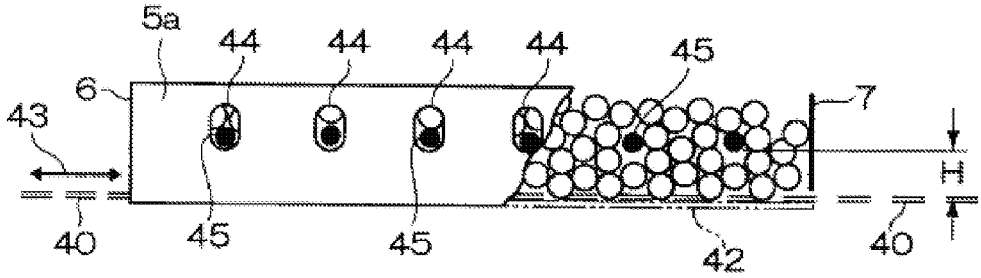
Figure 10C:
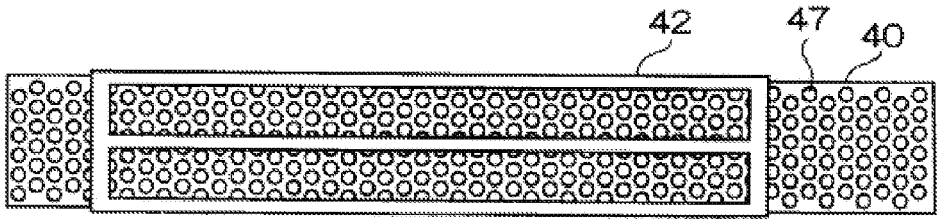
Figure 11:
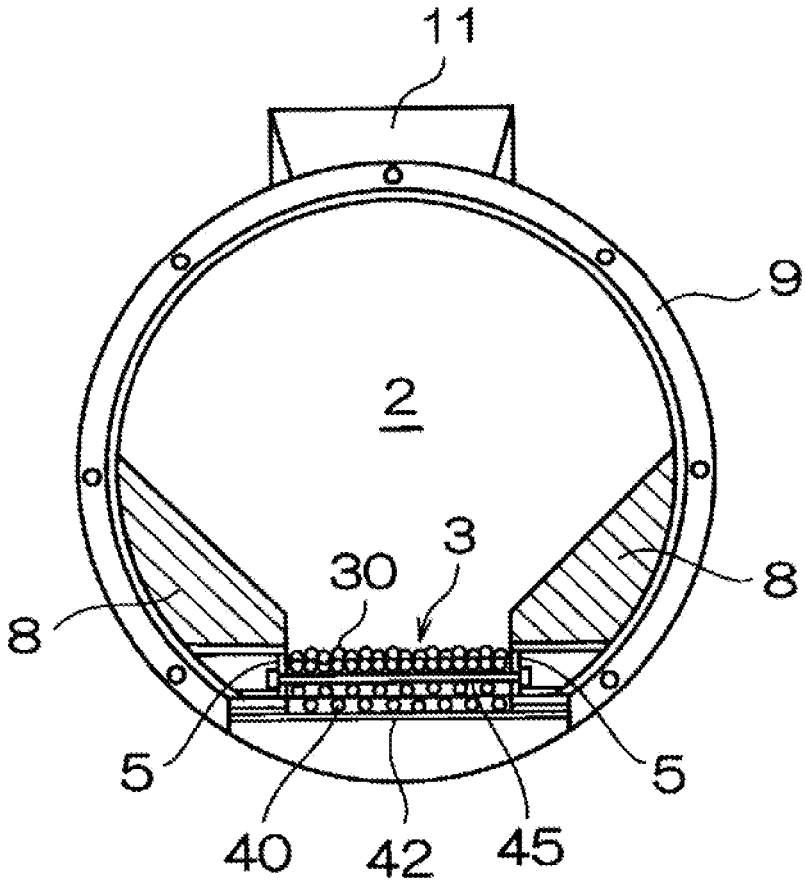
FIG. 11 is a sectional diagram of the embodiment 3 like that seen along the arrow VI-VI in FIG. 4.

The explanation will be made with reference to FIGS. 10 and 11 as to still another embodiment of the stirring section for the fire bed 3 relating to the characterizing portion of the invention. FIG. 10(*a*) is a sectional diagram showing the periphery of the fire bed 3, FIG. 10(*b*) is a side view showing a partially-broken section of the fire bed 3, and FIG. 10(*c*) is a bottom view of the fire bed 3 seen from the lower side. FIG. 11 is a sectional diagram of this embodiment like that seen along the arrow VI-VI in FIG. 4.

As shown in these drawings, a porous plate 40 is disposed in a manner that its front and rear ends are inserted into a pair of slits 41, 41 formed at the front plate 6 and the rear plate 7 of the fire bed 3, respectively. Further, a supporting frame plate 42 is attached to the lower ends of the front plate 6 and the rear plate 7 and to the lower ends of the not-shown pair of the side plates 5, 5. As shown in FIG. 10(*c*), openings are formed at the entire surface of the supporting frame plate 42 so that the combustion air flows through the holes of the porous plate 40 from the lower side of the fire bed 3. The porous plate 40 is supported by these slits 41, 41 and the supporting frame plate 42 so as to be movable in directions shown by an arrow 43, that is, the front and rear directions of the fire bed 3. Although not shown, like the embodiment 1, a driving section for moving the porous plate 40 is formed in a manner that a rod-shaped member is coupled to the one end portion of the porous plate 40 and extracted to the outside of the combustion furnace 1 and is moved in the directions shown by the arrow 43 by a human power or an electric motor.

Further, as shown in FIG. 10(*b*), a plurality of long holes 44 each elongated in the vertical direction are formed at each of the pair of the side plates 5, 5 disposed vertically with respect to the porous plate 40 in a manner that the long holes are formed with an interval in the front and rear direction of the side plates 5, 5 at corresponding opposed positions of the side plates. A stirring rod 45 is inserted in corresponding pair of the opposed long holes 44 of the pair of the side plates 5, 5 in a manner that the both ends of each of the stirring rods are respectively inserted into the corresponding pair of the opposed long holes. In this manner, the ceramic balls 30 are covered all over the area surrounded by the pair of the side plates 5, 5, the front plate 6 and the rear plate 7 to form the fire bed 3.

According to the aforesaid configuration, when the porous plate 40 is moved in the front and rear directions, the lower portions of the ceramic balls 30 are caught in the primary air ejection holes 47 of the porous plate 40 and so move vertically in a vibrational manner. In this case, since the vertical movement of the ceramic balls 30 is restricted by the plurality of stirring rods 45, the ceramic balls move in a complicated manner. Thus, the clinker is broken finely by the complicated movements of the ceramic balls 30 and further the clinker is broken into fine pieces by the vertical and left- and right-direction movements of the ceramic balls 30 and the woody pellets.

Since the stirring rods 45 move vertically within the long holes 44, the vertical movements of the ceramic balls 30 is permitted, whereby forces applied to the porous plate 40 and the stirring rods 45 can be weakened.

In this case, preferably the diameter of the ceramic ball 30 is larger than the diameter of the hole of the primary air ejection hole 47 of the porous plate 40. For example, the outer diameter of the ceramic ball 30 is 5 mmϕ and the diameter of the hole of the primary air ejection hole 47 is 3 mmϕ. Thus, since the lower portion of the ceramic ball 30 is buried into the primary air ejection hole 47, even when the ceramic ball 30 is forced to move in accordance with the front- and rear-direction movement of the porous plate 40, the front- and rear-direction movement of the ceramic ball 30 is interfered by the adjacent other ceramic balls 30, whereby the ceramic ball moves vertically in a manner of springing out from the primary air ejection hole 47. Due to such the movement of the ceramic balls 30, the clinker is broken finely and the ash deposited on the layer of the ceramic balls 30 is stirred and scattered. Although a height H from the lower surface of the stirring rods 45 to the porous plate 40 is not particularly limited, this height may be about 2.5 times or more as large as the size of the ceramic ball 30. Further, the diameter of the stirring rod 45 may be 4 mmϕ, for example.

According to this embodiment, the ceramic balls 30 can move not only in the front and rear directions but also move vertically in a vibrational manner in response to the front- and rear-direction movement of the porous plate 40, and hence the clinker can be broken finely. As a result, the growth of the clinker can be suppressed and hence the generation of the burning trouble can be prevented.

According to the stirring section of the embodiment 1, in the case of moving the stirring member 22 in the front or rear direction within the fire bed 3, if aligned layers of the ceramic balls 30 are formed between the stirring member 22 and the front plate 6 or the rear plate 7, there may arise a case that the movement of the stirring member 22 is restricted and so the stirring operation becomes difficult. However, according to this embodiment, such the problem can be avoided.

EXPLANATION OF SIGNS

1 combustion furnace
2 combustion chamber
3 fire bed
4 porous plate
5 side plate
6 front plate
7 rear plate
8 heat-resistant member
11 shooter
12 burner tube
21 movable member
22 stirring member
25 pin member
26 heat-resistant cover
30 ceramic ball
31 woody pellet
40 porous plate
41 slit
42 supporting frame plate
44 long hole
45 stirring rod
47 primary air ejection hole

The invention claimed is:

1. An apparatus for burning woody pellets, comprising:

a porous plate which includes many holes;

a fire bed which is formed by covering ceramic particles in a layer manner on the porous plate;

fuel supply section which supplies woody pellets on the fire bed;

air supply section which supplies combustion air to the fire bed from the holes of the porous plate;

a firing burner which fires the woody pellets;

a secondary combustion space which introduces combustion gas generated from the fire bed therein and burns the gas; and a stirring section which stirs the layer of the ceramic particles on the fire bed by using a member which moves along a plate surface of the porous plate, wherein the fire bed is formed by covering the ceramic particles in a layer manner in an area surrounded by a pair of side plates disposed vertically with respect to the porous plate and a front plate and a rear plate respectively disposed at both ends of the side plates, and the porous plate is supported so as to be movable in front and rear directions in a manner that a front end and a rear end thereof are respectively inserted into slits formed at the front plate and the rear plate, and the stirring section includes:

a plurality of long holes each elongated in a vertical direction which are formed at each of the pair of the side plates of the fire bed in a manner that the long holes are formed with an interval in the front and rear direction of the side plates at corresponding opposed positions of the side plates;

a plurality of stirring rods each of which is inserted in corresponding pair of the opposed long holes of the pair of the side plates; and a driving section which moves the porous plate in the front and rear directions.

* * * * *